US005286019A

United States Patent [19]

Watabe

[11] Patent Number: 5,286,019

[45] Date of Patent: Feb. 15, 1994

[54] COMBINATION GOLF CLUB HANDLE SUPPORT AND WIPER

[76] Inventor: Jason M. Watabe, 9200 NE. 131st Pl., Kirkland, Wash. 98034

[21] Appl. No.: 973,647

[22] Filed: Nov. 9, 1992

[51] Int. Cl.[5] ..... A63B 57/00; B65B 67/12

[52] U.S. Cl. ..... 273/32 B; 248/156; 248/530; 15/210.1

[58] Field of Search ..... 248/156, 530, 545; 15/209.1, 210.1; 273/32 R, 32 B, 32 H, 32 E

[56] References Cited

U.S. PATENT DOCUMENTS

| | | | |
|---|---|---|---|
| 1,443,230 | 1/1923 | Luckett | 248/530 |
| 4,063,731 | 12/1977 | Cooper et al. | 273/32 B |
| 4,403,366 | 9/1983 | Lucke | 15/209.1 |
| 4,497,077 | 2/1985 | Provost | 248/156 X |
| 4,516,616 | 5/1985 | Fesler | 15/210.1 X |
| 4,940,201 | 7/1990 | Kurth | 248/156 X |
| 5,139,219 | 8/1992 | Navarro | 248/156 X |
| 5,147,703 | 9/1992 | Provost et al. | 273/32 B X |
| 5,149,087 | 9/1992 | Thompson | 273/32 B |

*Primary Examiner*—George J. Marlo
*Attorney, Agent, or Firm*—Robert W. Jenny

[57] ABSTRACT

The combination comprises a support and a wiper detachably attachable to the support. The support comprises a shaft being pointed at one end and having an essentially semi-circular bracket attached to its other end, the shaft and bracket lying essential in a flat plane. The wiper is a small, pleated towel with a tab portion attached at one end. VELCRO (T.M.) fastener components are attached to the tab so that the tab may be folded over and detachably straddle the bracket, In use the support is pushed essentially vertically into terrain and one or more golf club handles laid into the bracket to hold them off the terrain. The wiper is used to remove contamination from the handles, heads and shafts of the golf clubs.

1 Claim, 1 Drawing Sheet

FIG. 1
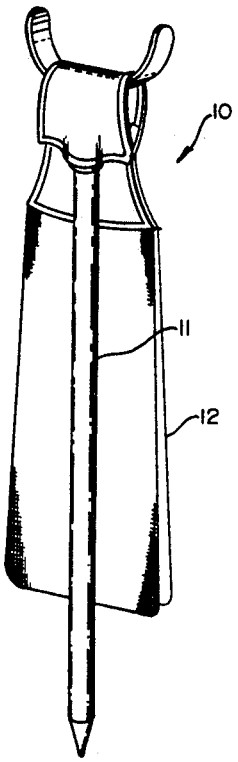
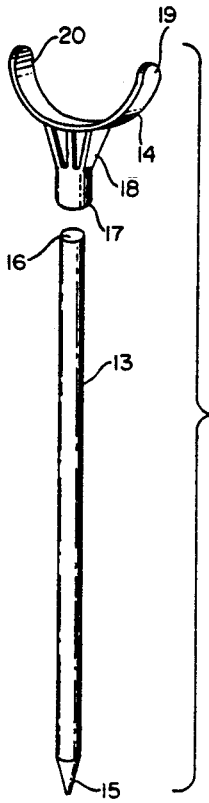
FIG. 2
FIG. 3
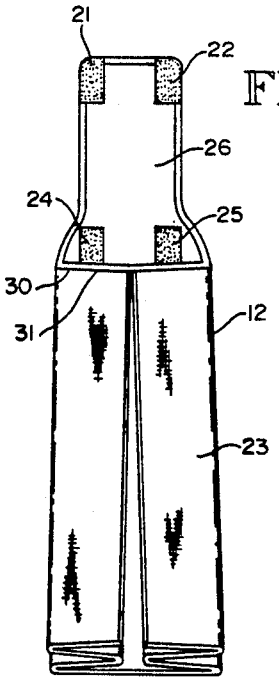
FIG. 4
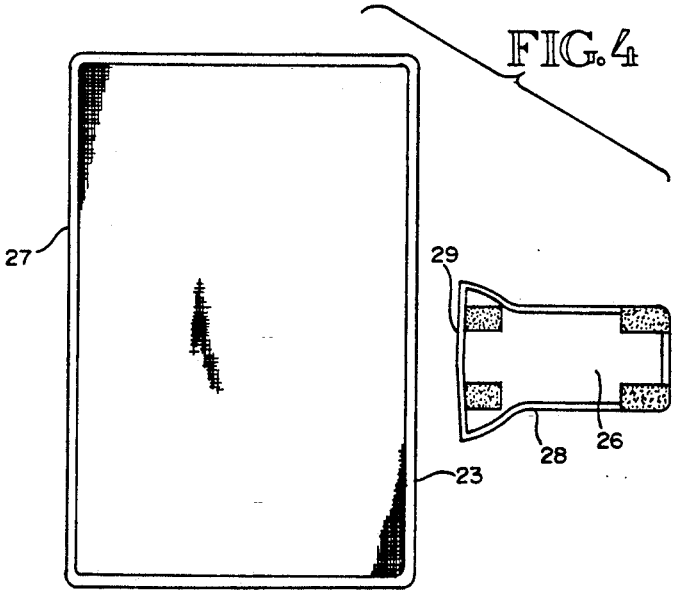

COMBINATION GOLF CLUB HANDLE SUPPORT AND WIPER

BACKGROUND OF THE INVENTION

1. Field

The subject invention is in the field of racks, holders, supports and the like for various tools, equipment and implements and articles and equipment used in the care, use and maintenance of such tools, etc. Specifically it is in the field of apparatus used for making and keeping such items more readily accessible and/or protecting them from contamination and/or damage while they are not in use and for decreasing the chances for losing such tools, etc. More specifically the subject invention is in the field of supports for items equipped with long handles, such as certain garden tools, baseball bats, fishing poles and golf clubs. Still more specifically it is in the field of supports of implements, the optimum use of which requires that their handles be clean and dry, the handles of golf clubs being a specific example.

2. Prior Art

There is no patented prior art known to the inventors of the subject invention. Non-patented prior art includes supports for fishing poles (while the poles are in use), tool supports attachable to walls or panels, garden hose holders, supports for plants and tree limbs and rests for items such as paint brushes and rollers and hot metal working tools and fireplace implements. The only prior art item known to the inventors that is specifically related to the subject invention and golf is the little implement used to repair dents on golf greens. Some of these tools are shaped to facilitate their being positioned in the ground to hold the handle of a golf club off the turf of the green or rough or terrain. Such an item is not satisfactory for the purposes of the subject invention since it can hold only one club and generally the uses of the item for repairing dents and holding a club are simultaneous. Further, a held handle is close to the terrain, subject to contamination, not easy to reach and there is no provision for holding any means for removing any contamination from the held handle.

Accordingly the prime objective of the subject invention is to provide equipment which supports golf club handles off the terrain far enough to inhibit their contamination by the terrain, and to keep them noticeably visible. A second objective is that the piece of equipment also hold a convenient detachably attachable wiper which is used to remove contamination and moisture from the handles and which makes the location of the clubs even more noticeable. Other objectives are that the item, called a support for purposes of this disclosure, be compact relative to its optimum usages, durable, and easily used and carried.

SUMMARY OF THE INVENTION

The subject invention is a combination of a support for the handles of golf clubs and a wiper detachably attached to the support. The combination is for use on golf courses at which there are restrictions which prohibit taking pulling carts or powered vehicles into certain areas These restrictions make it necessary for players to carry one or more golf clubs to where a ball lies. It is frequently necessary to carry more than one club because the player cannot predict at the location of the golf cart, pulled or powered, just which club the player will prefer at the location of the ball. The subject combination is used to support the clubs not used, keeping their handles free of contamination from the terrain, keeping them visible to help avoid their being left behind and providing a wiper for drying the handles and drying and cleaning the club heads when necessary. The wiper also serves to heighten the visibility of the clubs on the support.

The wiper may be flat and made of sponge-like material fitted with a grommet for attachment purposes. It may further include provision for advertising indicia and/or the name and/or telephone number of the owner.

The apparatus comprises (1) a support further comprising a shaft, pointed at one end with a generally semi-circular shaped bracket attached at the other and (2) a wiper, such as a pleated towel detachably attached to the support, preferably at or near the juncture of the shaft and bracket. A preferred means of detachably attaching the towel involves pads of VELCRO (T.M.) fastened to the towel such that one end of it can be folded over the bracket and held to the remainder of the towel by the VELCRO (T.M.) fastening pads. Alternately, one or more loops or rings may be fastened to the towel and the towel attached by slipping the loop(s) or ring(s) over a hook or hooks or snap clip or clips made part of or attached to the bracket.

The invention is described below in more detail with reference to the attached drawings.

BRIEF DESCRIPTION OF THE DRAWINGS

FIG. 1 is a perspective view of the subject combination.

FIG. 2 is an exploded view of the support.

FIG. 3 illustrates a preferred embodiment of a wiper made of towel material and using VELCRO (T.M.) fastening means.

FIG. 4 is an exploded view of the wiper of FIG. 3.

DETAILED DESCRIPTION OF THE INVENTION

The subject invention is a combination of a support for the handles of golf clubs and a wiper detachably attachable to the support. FIG. 1 illustrates a preferred embodiment 10 of the combination. The combination comprises support 11 and wiper 12 fastened to it. FIG. 2 is an exploded view of the support which comprises shaft 13 and bracket 14. End 15 of the shaft is pointed to facilitate its insertion into terrain for support to hold it generally erect. End 16 of the shaft is inserted into a hole 17, not visible in this view, in base 18 of bracket 14. The shaft is fastened in the hole, such as with adhesive, to facilitate removal of the support from terrain by grasping and pulling on the bracket. Arms 19 and 20 of the bracket together are essentially semicircular and the bracket is sized to accommodate a plurality of golf club handles. The axis of hole 17 and arms 19 and 20 lie essentially in a flat plane.

FIG. 3 illustrates a preferred embodiment of wiper 12, having VELCRO (T.M.) loop components 21 and 22 fastened to tab component 23 as shown and VELCRO (T.M.) hook components 24 and 25 also fastened to component 23 as shown. With this arrangement the wiper may be folded over the bracket with tab 23 straddling base 18 of the bracket so that the VELCRO (T.M.) components interconnect to hold the wiper in place.

FIG. 4 is an exploded view of the wiper 12. It comprises the toweling material component 26 and the fabric component 23. Component 23 is similar to a large wash cloth or small towel, double hemmed on its sides, side 27 being typical. In assembly of the wiper component 23 is pleated as indicated in FIG. 3. Component 26 is made of suitable cloth, shaped as shown and also double hemmed on all its edges, edge 28 being typical. The wiper is assembled by sewing edge 29 across end 30 of the pleated component 33, as indicated at 31 in FIG. 3.

It is considered to be understandable from this description that the subject invention meets its objectives. It provides equipment which supports golf club handles off the ground far enough to inhibit their contamination by the terrain and to keep them noticeably visible. Also, it provides a wiper conveniently detachably attachable to the support of the combination, adding to the visibility of the combination. The combination is also compact relative to its purposes and is durable and easily used and carried.

It is also considered to be understood that while one embodiment of the invention is described herein, other embodiments and modifications of the one described are possible within the scope of the invention which is limited only by the attached claims.

I claim:

1. In combination a wiper and a support for a plurality of golf clubs handle and said wiper, said support being supportable in terrain, said support comprising a shaft having first and second ends, and a bracket having a base and first and second arms extending upward from said base and shaft connecting means in said base, intermediate said arms, said connecting means and said arms lying generally in a single plane, said arms being spaced apart and configured to hold said handles on said support.

said first end of said shaft having a tapered configuration to facilitate penetration of said shaft in said terrain, said second end of said shaft including means for being secured to said connecting means, said wiper including means for forming a detachable tab straddling said base intermediate said arms for detachably attaching said wiper to said support, whereby, said handles are made more visible by being supported on said support, said wiper increases said visibility and said wiper is useful for removing contamination from said handles.

* * * * *